US012622482B2

(12) United States Patent
Bar

(10) Patent No.: US 12,622,482 B2
(45) **Date of Patent: *May 12, 2026**

(54) EASY-ENTRY SHOE WITH AN INNER PART

(71) Applicant: ORTHOFEET, INC., Norwood, NJ (US)

(72) Inventor: Aharon Bar, Fort Lee, NJ (US)

(73) Assignee: ORTHOFEET, INC (IL)

( * ) Notice: Subject to any disclaimer, the term of this patent is extended or adjusted under 35 U.S.C. 154(b) by 0 days.

This patent is subject to a terminal disclaimer.

(21) Appl. No.: 18/120,954

(22) Filed: Mar. 13, 2023

(65) Prior Publication Data

US 2023/0284737 A1 Sep. 14, 2023

Related U.S. Application Data

(63) Continuation-in-part of application No. 17/488,032, filed on Sep. 28, 2021, now Pat. No. 11,622,598.

(60) Provisional application No. 63/233,451, filed on Aug. 16, 2021.

(51) Int. Cl.

| | |
|---|---|
| ***A43B 13/28*** | (2006.01) |
| ***A43B 1/00*** | (2006.01) |
| ***A43B 11/00*** | (2006.01) |
| ***A43B 23/02*** | (2006.01) |
| ***A43B 23/07*** | (2006.01) |

(52) U.S. Cl.

CPC ..... *A43B 11/00* (2013.01); *A43B 23/028* (2013.01); *A43B 23/07* (2013.01)

(58) Field of Classification Search

None

See application file for complete search history.

(56) References Cited

U.S. PATENT DOCUMENTS

| | | | | |
|---|---|---|---|---|
| 2,440,563 | A * | 4/1948 | Woyach | A43B 3/02 36/55 |
| 4,845,862 | A * | 7/1989 | Phillips, Jr. | A43B 23/07 36/43 |
| 5,259,126 | A * | 11/1993 | Rosen | A43B 23/28 36/97 |
| 6,836,916 | B2 * | 1/2005 | Chen | A43B 23/07 36/19 A |
| 9,532,624 | B2 * | 1/2017 | Lap | B29D 35/04 |
| 9,936,764 | B2 * | 4/2018 | Lo | A43B 3/02 |
| 2006/0137223 | A1 * | 6/2006 | Ziccarelli | A43B 19/00 36/55 |
| 2008/0047167 | A1 * | 2/2008 | Pawlus | A43B 3/0047 36/15 |
| 2014/0137434 | A1 * | 5/2014 | Craig | A43B 23/0215 66/170 |
| 2015/0305442 | A1 * | 10/2015 | Ravindran | A43B 23/0235 36/138 |
| 2017/0172247 | A1 * | 6/2017 | Lee | A43B 7/12 |

(Continued)

*Primary Examiner* — Jila M Mohandesi

(74) *Attorney, Agent, or Firm* — Smith Tempel Blaha LLC; Gregory Scott Smith

(57) ABSTRACT

A shoe including a sole, and a shoe upper, the shoe upper including an opening and a vamp, the shoe upper also including an inner layer and an outer layer, where the bottom part of the outer layer is attached to the sole, where the inner layer is attached to the outer layer at a front part of the opening, and where the attachment of the inner layer to the outer layer at the front part of the opening is operative to prevent a front part of the inner layer from bending when an object is inserted into the shoe.

6 Claims, 4 Drawing Sheets

(56) References Cited

U.S. PATENT DOCUMENTS

| | | | | |
|---|---|---|---|---|
| 2017/0231324 | A1* | 8/2017 | Arquilla | A43B 23/07<br>36/10 |
| 2017/0295851 | A1* | 10/2017 | Thibodeau | A43B 5/0405 |
| 2020/0146390 | A1* | 5/2020 | Heidenfelder | A43B 23/0235 |
| 2023/0052916 | A1 | 2/2023 | Bar | |

* cited by examiner

EASY-ENTRY SHOE WITH AN INNER PART

FIELD

The field of the present disclosure and the related embodiments relate to the field of footwear, and, more particularly but not exclusively, to footwear, such as a shoe, enabling easy entry of a foot into the shoe.

BACKGROUND

A significant number of users have difficulties bending down to help put on shoes with closed heel design. However, when putting shoes on and off, most shoes require bending down to lace or unlace the shoe, or help adjusting the rear part of the shoe to enter slip-on shoes. There is thus a widely recognized need for a shoe that enables a user to put it on and off without the need for bending down and using the user's hands.

Many such easy-entry shoe are disclosed, such as disclosed in U.S. Pat. Nos. 1,686,175, 9,675,132, 9,820,527, 9,877,542, U.S. Ser. No. 10/306,947, U.S. Ser. No. 10/506,842, U.S. Ser. No. 10/555,578, U.S. Ser. No. 10/638,810, U.S. Ser. No. 10/653,209, U.S. Ser. No. 10/660,401, U.S. Ser. No. 10/813,405, U.S. Ser. No. 10/842,222, U.S. Ser. No. 10/905,192, U.S. Ser. No. 10/973,279, and US application US20210106094, as well as PCT application WO2012077899. These solutions involve compression of the rear side of the shoe to enable the foot to enter the shoe, and a spring element that returns the compressed rear side to upright position. However, these constructions are costly to manufacture and uncomfortable to wear because of the rigid structure around the heel. Therefore, there is a need for a shoe with a more simplified construction that is easier and inexpensive to produce.

SUMMARY

According to one exemplary embodiment there is provided an article of wear such as a shoe including a sole, and a shoe upper, the shoe upper including an opening and a vamp, the shoe upper also including an inner layer, and an outer layer, where the bottom part of the outer layer is attached to the sole, and where the inner layer is attached to the outer layer at a front part of the opening.

According to another exemplary embodiment the inner layer is attached to the outer layer within at least one of: lateral side of the opening, and medial side of the opening.

According to still another exemplary embodiment the inner layer is separated from the outer layer in the front part of the opening area and the vamp area. The vamp is the front and center part of a shoe's upper that covers the top of the foot.

According to yet another exemplary embodiment the inner layer is made from a softer material than the outer layer.

Further according to another exemplary embodiment, the inner layer is attached to the outer layer with a stitch at the front part of the opening.

Still further, according to another exemplary embodiment the attachment of the inner layer to the outer layer at the front part of the opening is operative to prevent a front part of the inner layer from bending when an object is inserted into the shoe.

Unless otherwise defined, all technical and scientific terms used herein have the same meaning as commonly understood by one of ordinary skill in the relevant art. The materials, methods, and examples provided herein are illustrative only and not intended to be limiting. Except to the extent necessary or inherent in the processes themselves, no particular order of steps or stages of methods and processes described in this disclosure, including the figures, is intended or implied. In many cases the order of process steps may vary without changing the purpose or effect of the methods described.

Implementation of the method and system of embodiments disclosed below involves performing or completing certain selected tasks or steps manually, automatically, or any combination thereof. Moreover, according to actual instrumentation and equipment of preferred embodiments of the method and system presented herein several selected steps could be implemented by hardware or by software on any operating system of any firmware or any combination thereof. For example, as hardware, selected steps could be implemented as a chip or a circuit. As software, selected steps could be implemented as a plurality of software instructions being executed by a computer using any suitable operating system. In any case, selected steps of the method and system disclosed herein could be described as being performed by a data processor, such as a computing platform for executing a plurality of instructions.

BRIEF DESCRIPTION OF THE DRAWINGS

Various embodiments are described herein, by way of example only, with reference to the accompanying drawings. With specific reference now to the drawings in detail, it is stressed that the particulars shown are by way of example and for purposes of illustrative discussion of the preferred embodiments only, and are presented in order to provide what is believed to be the most useful and readily understood description of the principles and conceptual aspects of the embodiment. In this regard, no attempt is made to show structural details of the embodiments in more detail than is necessary for a fundamental understanding of the subject matter, the description taken with the drawings making apparent to those skilled in the art how the several forms and structures may be embodied in practice.

In the drawings.

DESCRIPTION OF EMBODIMENTS

Figure 1:
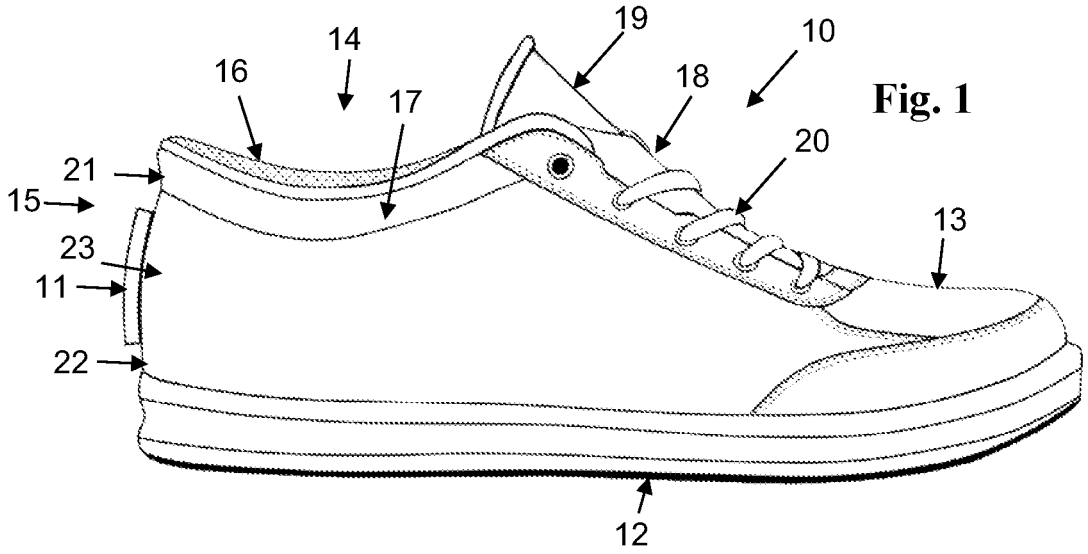
FIG. 1 is a simplified illustration of a side view of an easy entry footwear with a rear spring.

The principles and structure according to some embodiments of a footwear, such as a laced shoe or a slip-on shoe, providing easy entry of the user's foot, may be better understood with reference to the drawings and accompanying description.

Before explaining at least one embodiment in detail, it is to be understood that the embodiments are not limited in its application to the details of construction and the arrangement of the components set forth in the following description or illustrated in the drawings. Other embodiments may be practiced or carried out in various ways. Also, it is to be understood that the phraseology and terminology employed herein is for the purpose of description and should not be regarded as limiting.

In this document, an element of a drawing that is not described within the scope of the drawing and is labeled with a numeral that has been described in a previous drawing has the same use and description as in the previous drawings. Similarly, an element that is identified in the text by a numeral that does not appear in the drawing described by the text, has the same use and description as in the previous drawings where it was described.

The drawings in this document may not be to any scale. Different drawings may use different scales and different scales can be used even within the same drawing, for example different scales for different views of the same object or different scales for the two adjacent objects.

The terms 'a' or "an', as used herein, are defined as one or more than one. The term plurality, as used herein, is defined as two or more than two. The term another, as used herein, is defined as at least a second or more. The terms including and/or having, as used herein, are defined as comprising.

The term coupled, as used herein, is defined as connected, although not necessarily directly, and not necessarily mechanically.

The term 'flexible' or 'elastic' may refer to a material of a part of a shoe that may be stretched and/or compressed by exerting a force, and may assume the original shape when the force is removed. The term 'firm' or 'rigid' may refer to a material of a part of a shoe that is not 'flexible' or 'elastic' and may thus retain its shape under the force that stretches and/or compresses the 'flexible' or 'elastic' material or part of the shoe.

Reference is now made to FIG. 1, which is a simplified illustration of a side view of an easy-entry footwear 10 with a rear spring 11, according to one embodiment.

Footwear, or shoe, 10 of FIG. 1 is a right-shoe adapted for a right foot of a human user (not shown in FIG. 1). A left shoe adapted for a left foot of a human user may be similar to footwear, or a shoe, 10 of FIG. 1.

Footwear, or shoe 10 may include a sole 12 and an upper 13. The upper 13 may have a shoe opening 14 for entering a foot of a user into shoe 10. The shoe opening 14 may be defined by a rear part 15, a medial part 16, a lateral part 17 and a front part 18. Footwear, or shoe 10 may also include a tongue part 19 and a lacing system 20. Various types of tongue part 19, lacing system 20 and other closure systems are contemplated.

Rear part 15 may include a top part 21, a bottom part 22, and a center part 23 located between top part 21 and bottom part 22. Top part 21 and bottom part 22 may be made of a firm and/or rigid material, that may not bend forward under the force exerted by a foot while entering shoe 10 and while pressing down top part 21. Center part 23 may be made from an elastic and/or flexible material that may be compressed under the force exerted by a foot while entering shoe 10.

Figure 2A:
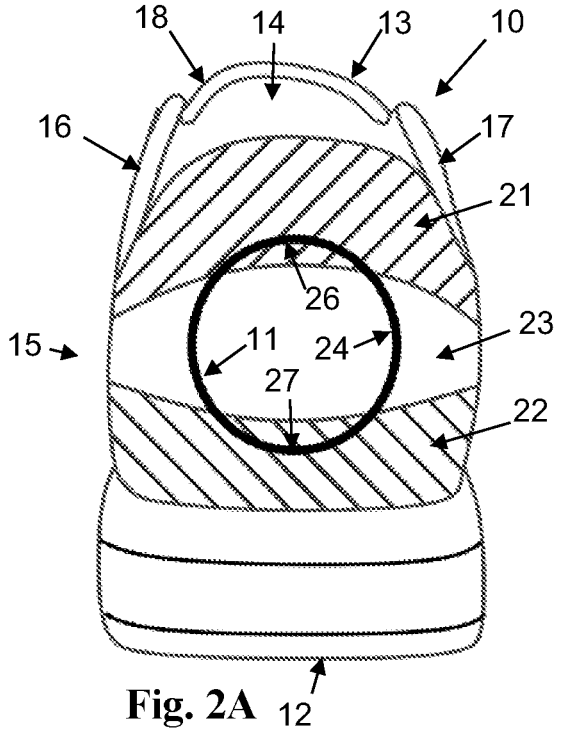
FIG. 2A is a simplified illustration of a rear view of the interior of rear part of an easy entry footwear with a circular rear spring.
Figure 2B:
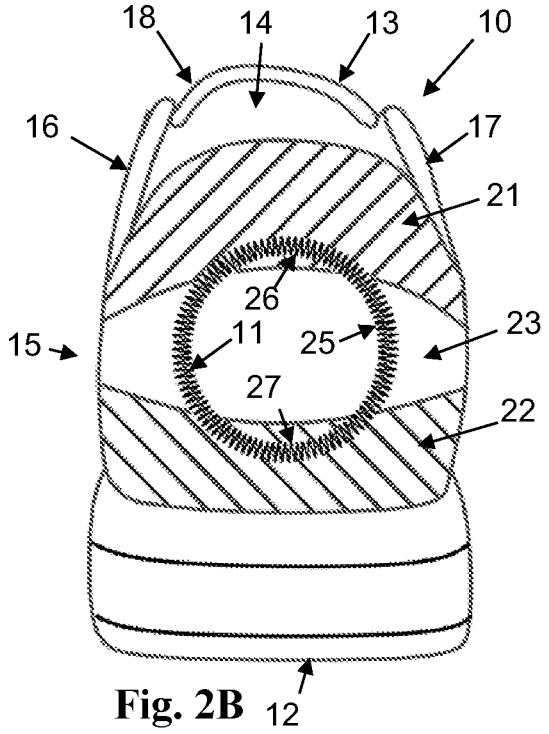
FIG. 2B is a simplified illustration of a rear view of the interior of rear part of an easy entry footwear with a garter rear spring.

Reference is now made to FIG. 2A, which is a simplified illustration of a rear view of the interior of rear part 15 with a circular spring 24, according to one embodiment, and to FIG. 2B, which is a simplified illustration of a rear view of the interior of rear part 15 with a garter spring 25, according to one embodiment.

As an option, the illustrations of FIG. 2A and FIG. 2B may be viewed in the context of the details of the previous Figures. Of course, however, the illustrations of FIG. 2A and FIG. 2B may be viewed in the context of any desired environment. Further, the aforementioned definitions may equally apply to the description below.

According to one embodiment, rear spring 11 may be a compression spring mounted between top part 21 and bottom part 22. Alternatively, rear spring 11, or compression spring 11 may be mounted between top part 21 and sole 12. Rear spring 11 may be coupled on one of its ends to top part 21, and to bottom part 22 on its other end. Rear spring 11 may be mounted over (on the outside of) center part 23, or within center part 23. Rear spring 11, or compression spring 11, may be a single spring element of any shape and form and may be made to conform to the shape of rear part 15 of shoe 10. Rear spring 11, or compression spring 11, may be mounted at about the horizontal middle of rear part 15, at the very rear end of shoe 10. Rear spring 11, or compression spring 11, may be the only spring element coupling between top part 21 and bottom part 22 or sole 12

When a foot enters shoe 10 and presses down top part 21, top part 21 may move down with respect to bottom part 22, thus compressing rear spring 11.

When the foot rests inside shoe 10 the foot no longer applies downward force on top part 21, rear spring 11 is allowed to push top part 21 up to its original position.

It is appreciated that the location of rear spring 11, and the shape of rear spring 11, are adapted to have a minimal effect on the flexibility of opening 14. Thus, the location of rear spring 11, and the shape of rear spring 11, allow opening 14 to adapt to the shape of the particular foot when the foot rests in shoe 10. In this respect, opening 14 may refer to the upper edges of rear part 15, medial part 16, lateral part 17, and front part 18.

As shown in FIG. 2A, circular spring 24, which is a rear spring 11 is shaped as a ring, however, other forms of spring 11 are contemplated, such as a horizontal or a vertical ellipse, or an oval form. For example, FIG. 2B shows shoe 10 with rear spring 11 in the form of circular garter spring 25. Garter 25 spring may comprise a coiled spring made of carbon steel, stainless steel, or any other material, which is connected at each end to create a circular shape.

As shown in FIGS. 2A and 2B, circular spring 24, and/or garter spring 25, may be coupled by its top portion 26 to top part 21, and by its bottom portion 27 to bottom part 22. Alternatively, circular spring 24 may be coupled by its top portion 26 to top part 21, and by its bottom part 27 to sole 12.

Figure 3A:
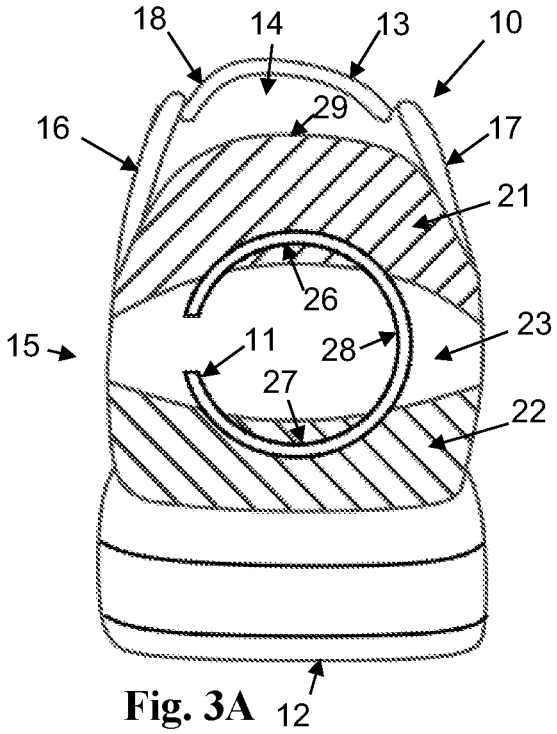
FIG. 3A is a simplified illustrations of a rear view of the interior of rear part of the easy entry footwear, with rear spring of an open circular shape with its two edges not connected to each other, and in uncompressed mode.
Figure 3B:
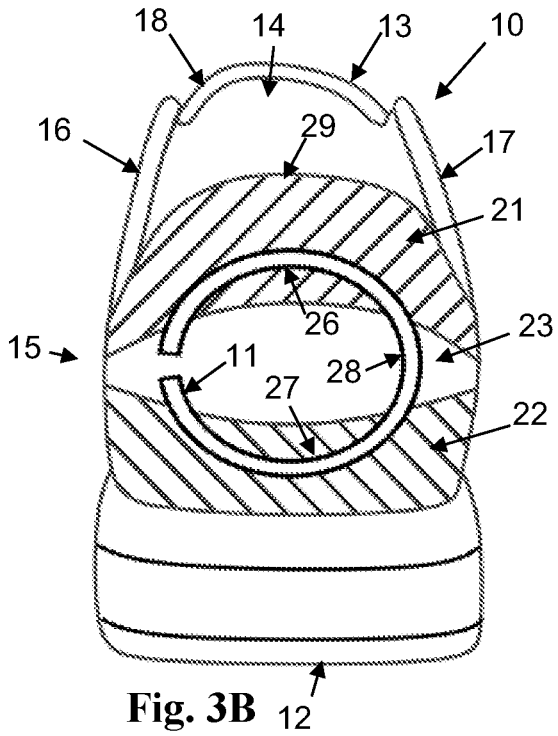
FIG. 3B is a simplified illustrations of a rear view of the interior of rear part of the easy entry footwear, with rear spring of an open circular shape with its two edges not connected to each other, and in compressed mode.

Reference is now made to FIG. 3A and FIG. 3B, which are simplified illustrations of a rear view of the interior of rear part 15 of shoe 10 with circular spring 28 where its two edges are not connected, according to one embodiment. FIG. 3A depicts rear part 15 and spring 28 in uncompressed mode, and FIG. 3B depicts rear part 15 and spring 28 in a compressed mode.

As an option, the illustrations of FIG. 3A and FIG. 3B may be viewed in the context of the details of the previous Figures. Of course, however, the illustrations of FIG. 3A and FIG. 3B may be viewed in the context of any desired environment. Further, the aforementioned definitions may equally apply to the description below.

As shown in FIGS. 3A and 3B spring 28 is another example of rear spring 11 and/or circular spring 24 with a shape of a partial circle, wherein its two edges are not connected. Spring 28 may be coupled by its top portion 26 to top part 21, and by its bottom portion 27 to bottom part 22. Alternatively, spring 28 may be coupled by spring top portion 26 to top part 21, and by its bottom portion 27 to sole 12.

As shown in FIG. 3B, top edge 29 of rear part 15 is lower than top edge 29 of rear part 15 in FIG. 3A, thus when top part 21 is depressed it offers more space for a foot to enter the shoe from the rear side of the shoe.

Figure 4A:
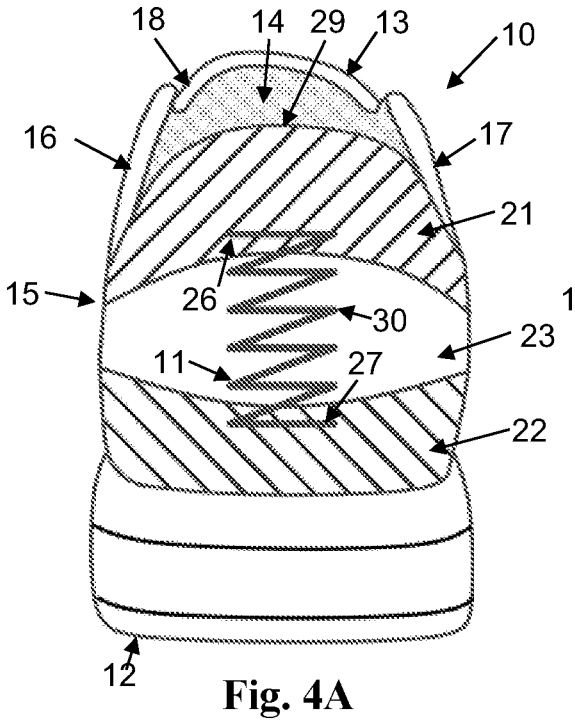
FIG. 4A is a simplified illustrations of a rear view of the interior of rear part of the easy entry footwear, with a sinusoidal compression spring, in uncompressed mode.
Figure 4B:
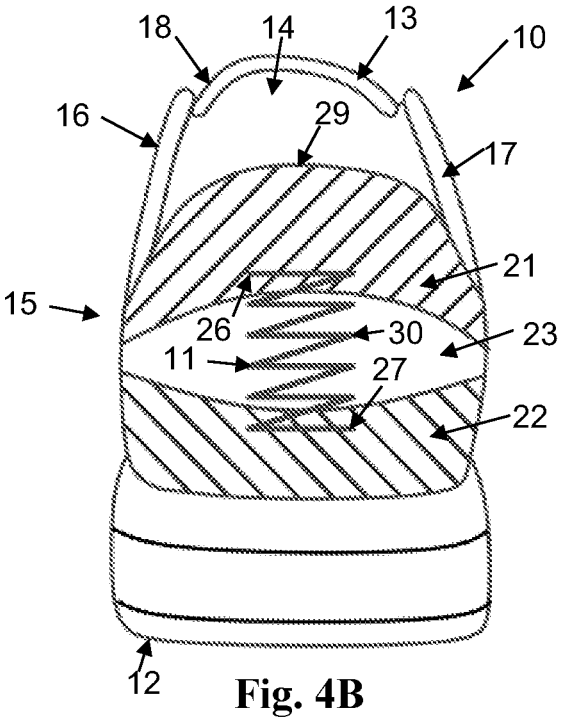
FIG. 4B is a simplified illustrations of a rear view of the interior of rear part of the easy entry footwear, with a sinusoidal compression spring, in compressed mode.

Reference is now made to FIG. 4A and FIG. 4B, which are simplified illustrations of a rear view of the interior of rear part 15 of shoe 10 with a sinusoidal compression spring 30, according to one embodiment. FIG. 4A depicts rear part 15 and/or sinusoidal compression spring 30 in uncompressed mode, and FIG. 4B depicts rear part 15 and/or sinusoidal compression spring 30 in a compressed mode.

As an option, the illustrations of FIG. 4A and FIG. 4B may be viewed in the context of the details of the previous Figures. Of course, however, the illustrations of FIG. 4A and FIG. 4B may be viewed in the context of any desired environment. Further, the aforementioned definitions may equally apply to the description below.

As shown in FIG. 4A and FIG. 4B, sinusoidal compression spring 30 is a rear spring 11 shaped as with repetitive form of sharp angles, and/or sharp curves. Any alternative repetitive form is also contemplated, such as a sinusoidal form. As shown in FIG. 4A and FIG. 4B, sinusoidal compression spring 30 may be mounted to contract vertically, and may be shaped in a laterally flat form, and may be mounted inside a sleeve (not shown in FIGS. 4A and 4B).

As shown in FIG. 4A and FIG. 4B, sinusoidal compression spring 30 may be attached to top part 21 in area 26, and to bottom part 22 in area 27. Spring 30 may be attached to rear part 15 over (on the outside of) center part 23 or within center part 23. Alternatively, sinusoidal compression spring 30 may be attached to top part 21 in area 26 and to sole 12 (not shown in FIGS. 4A and 4B).

Figure 5A:
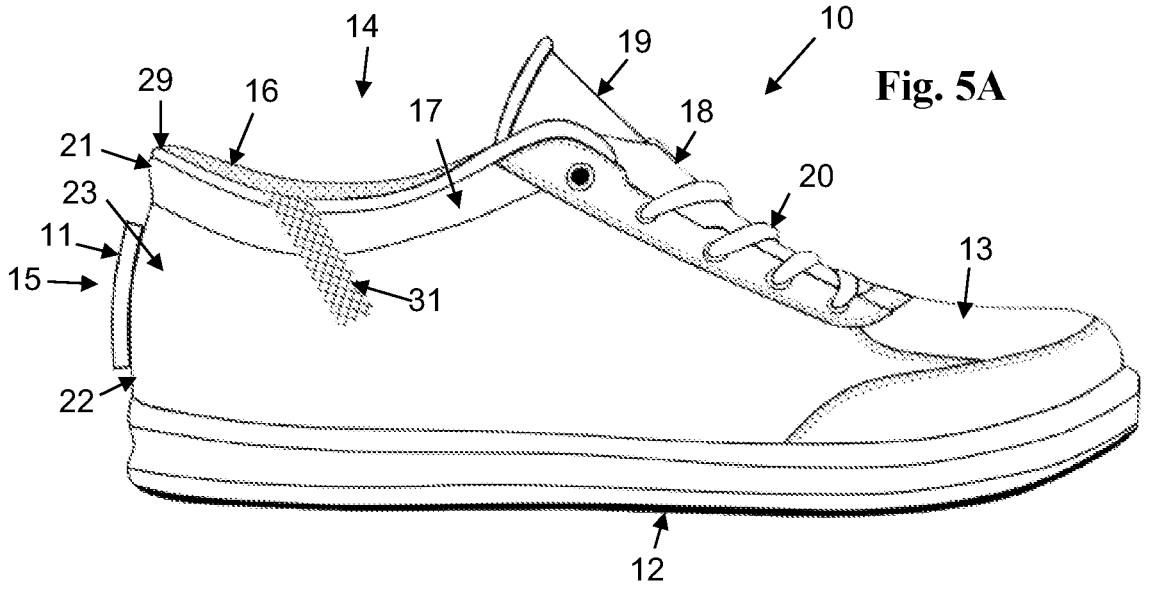
FIG. 5A is a simplified illustration of a side view of the easy entry footwear with rear part in an uncompressed position, and with an elastic element in an unstretched position.
Figure 5B:
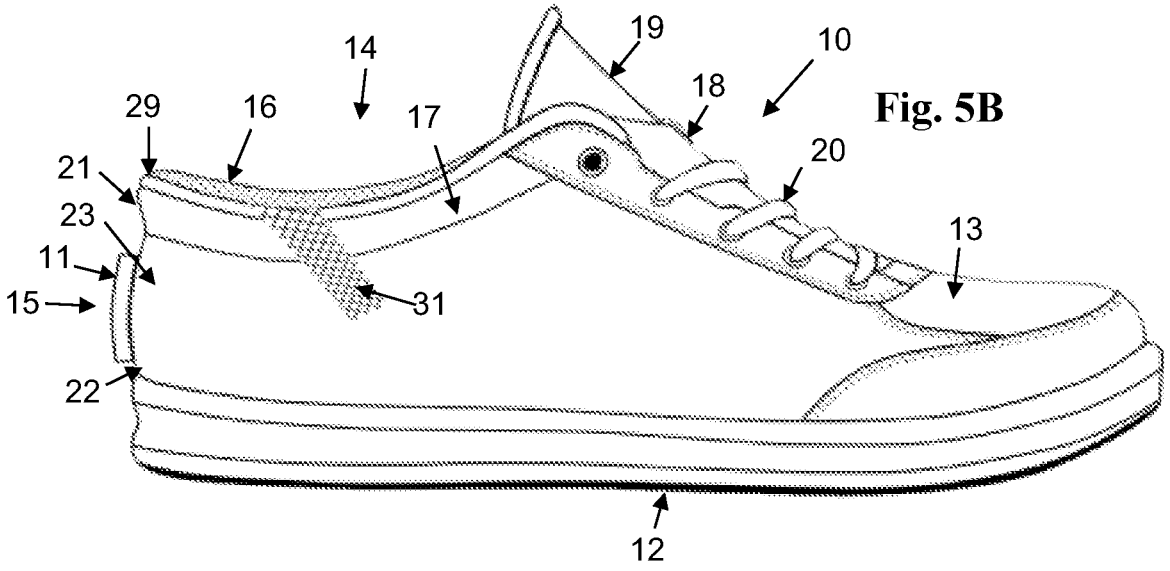
FIG. 5B is a simplified illustration of a side view of the easy entry footwear with rear part in a compressed position, and with an elastic element in a stretched position.

Reference is now made to FIG. 5A, which is a simplified illustration of a side view of shoe 10 with rear part 15 in an uncompressed position, and with an elastic element 31 in an unstretched position, and to FIG. 5B, which is a simplified illustration of a side view of shoe 10 with rear part 15 in a compressed position, and with an elastic element 31 in a stretched position, according to one embodiment.

As an option, the illustrations of FIG. 5A and FIG. 5B may be viewed in the context of the details of the previous Figures. Of course, however, the illustrations of FIG. 5A and FIG. 5B may be viewed in the context of any desired environment. Further, the aforementioned definitions may equally apply to the description below.

As shown in FIG. 5A, at least one part of shoe opening 14, such as, for example, elastic element 31, may be made of elastic material, such as rubber strap. Elastic element 31 is shown in FIG. 5A and FIG. 5B as part of lateral part 17, however, elastic element 31 may be alternatively mounted as part of medial part 16, or alternatively, as part of both medial part 16 and lateral part 17.

When the foot enters the shoe the elastic material of elastic element 31 stretches, thus enabling top portion 21 of rear part 15 to move down, and at the same time, allows shoe opening 14 to expand, providing enough space for the foot to go through the shoe opening. The elastic material may be allowed to contract once the foot enters the shoe, keeping the foot secured inside the shoe.

It is appreciated that rear spring 11, as described above or of any other shape and form, may be adapted to the shape of rear part 15. In this respect, rear spring 11 may be curved vertically, upwards, and forward, according to the curvature of rear part 15. In this respect, rear spring 11 may be curved horizontally according to the curvature of rear part 15.

Figure 6A:
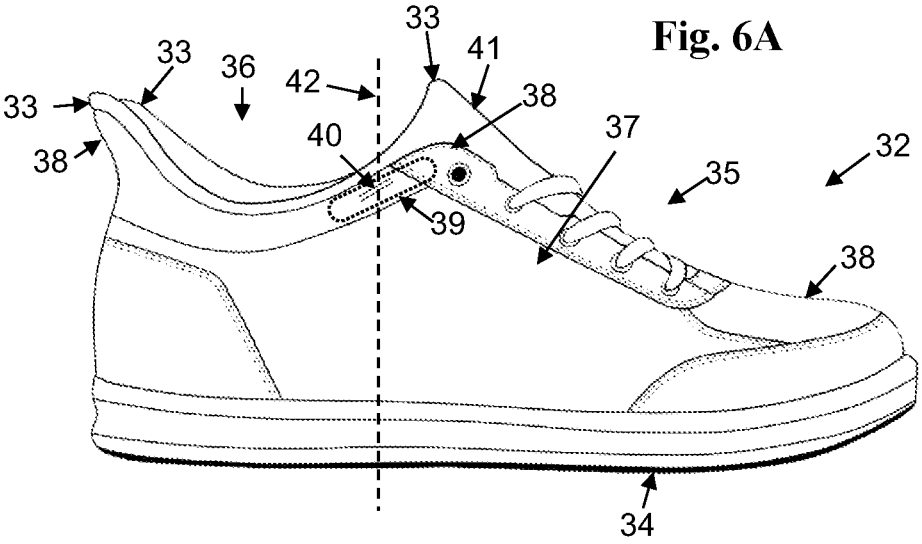
FIG. 6A is a simplified illustration of a side view of a shoe with an inner layer.
Figure 6B:
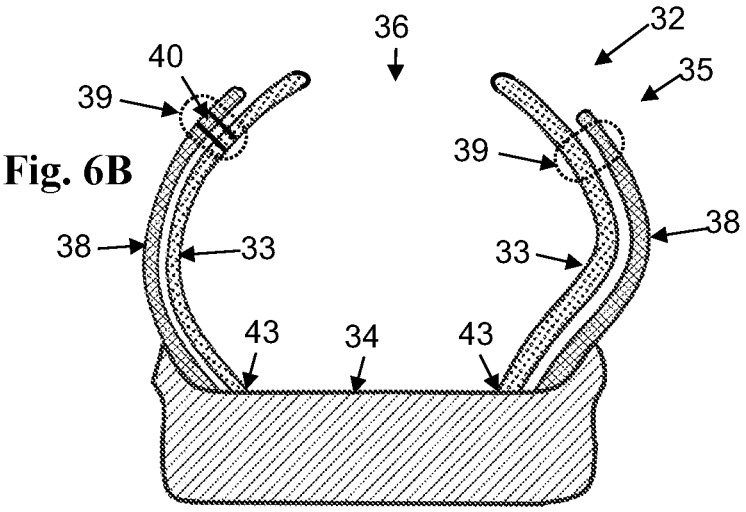
FIG. 6B is a simplified illustration of a cut view of the shoe and the separated inner layer.
Figure 6C:
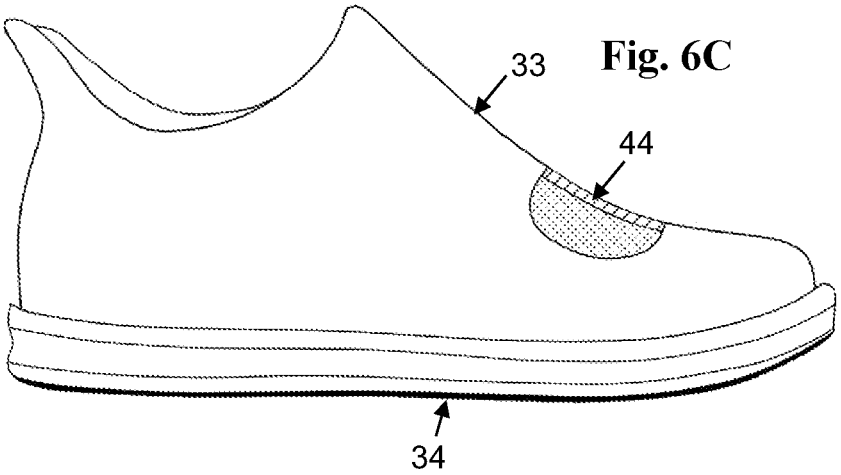
FIG. 6C is a simplified illustration of a side view of the inner layer attached to the sole of the shoe.

Reference is now made to FIG. 6A, which is a simplified illustration of a side view of shoe 32 with an inner layer 33, to FIG. 6B, which is a simplified illustration of a cut view of shoe 32 and inner layer 33, and to FIG. 6C, which is a simplified illustration of a side view of inner layer 33 attached to a shoe sole 34, according to one embodiment.

As an option, the illustrations of FIG. 6A, FIG. 6B, and FIG. 6C may be viewed in the context of the details of the previous Figures. Of course, however, the illustrations of FIG. 6A, FIG. 6B, and FIG. 6C may be viewed in the context of any desired environment. Further, the aforementioned definitions may equally apply to the description below.

As may be seen in FIG. 6A, shoe 32 may include sole 34 and a shoe upper 35. The shoe upper 35 may include a shoe opening 36, a vamp 37, an outer layer, 38 and an inner layer 33. The outer layer 38 and the inner layer 33 both include respective openings that are located at the shoe opening 36.

The inner layer 33 may be attached to the outer layer 38 within an area at the front part of opening 36. A simplified non-limiting example of an attachment area is designated in FIG. 6A by dotted line 39. For example, the inner layer 33 may be attached to the outer layer 38 substantially within area 39 at the front part of opening 36 with a stitching 40.

FIG. 6A shows attachment area 39 at the lateral side of shoe 32. It is appreciated that there may be a similar area and/or stitching at the medial side of shoe 32 and that inner layer 33 and outer layer 38 may be attached together within either the lateral area 39 or medial are 39 or both areas. Similarly, stitching 40 may be applied within lateral area 39 (as shown) or medial area 39 or both.

FIG. 6A shows that shoe inner layer 33 is typically higher than the outer layer 35 in the front part of the shoe opening 36. Namely, shoe inner layer 33 typically protrudes above and behind outer layer 38, typically in the front part of shoe the opening 36. Typically, a tongue part 41 of inner layer 33 may protrude above outer layer 38.

One purpose of the attachment, such as stitching 40, is to prevent the front upper part of the shoe inner layer 33, such as tongue part 41, from collapsing or bending under the friction caused by a foot being inserted into inner layer 33 of shoe 32.

FIG. 6B is a cut through the width of the shoe and at the location of the small stich 40 that connects shoe inner layer 33 to the outer layer 38. The cut is marked with dotted line 42 in FIG. 6A. FIG. 6B shows that shoe inner layer 33 is internal to outer layer 38. Therefore, shoe inner layer 33 is typically narrower than outer layer 38.

FIG. 6B shows that the bottom of shoe inner layer 33 is attached to shoe sole 34 at 43 and internally to, and/or separately from, outer layer 38. FIG. 6B also shows that shoe inner layer 33 is attached to the outer layer 38 with the stitching 40 at area 39 on the lateral side. FIG. 6B also shows area 39 on the medial side.

FIG. 6B additionally shows that shoe inner layer 33 is taller than outer layer 38 at opening 36, typically around opening 36. It is appreciated that the inner layer is separated from the outer layer at least in the front part of the shoe (e.g., from cut 42 and onward) and is attached to the outer layer in a limited area 39 in the front of the opening.

As seen in FIG. 6A and FIG. 6B, the shoe inner layer is attached to the outer layer with a single stitch 40 at the lateral side of shoe opening, however, a single stitch at the medial side of the shoe opening is also contemplated. It is also evident that the shoe inner layer 33 is detached from the outer layer 38 everywhere but the small stitch at the upper front part of the opening 36.

FIG. 6C shows the shoe inner layer 33 with a cutaway 44 showing the soft structure of inner layer 33.

It is expected that during the life of this patent various footwear technologies and materials will be developed and the scope of the terms herein, particularly of the terms "footwear", and "shoe", is intended to include all such new technologies and materials a priori.

Additional objects, advantages, and novel features of the embodiments described herein will become apparent to one ordinarily skilled in the art upon examination of the following examples, which are not intended to be limiting. Additionally, each of the various embodiments and aspects of embodiments as delineated hereinabove and as claimed in the claims section below finds experimental support in the following examples.

It is appreciated that certain features of the system and method described herein, which are, for clarity, described in the context of separate embodiments, may also be provided in combination in a single embodiment. Conversely, various features, which are, for brevity, described in the context of a single embodiment, may also be provided separately or in any suitable sub-combination.

Although the system and methods has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art.

What is claimed is:

1. A shoe comprising a sole, the shoe comprising:

a shoe upper comprising an opening for entering the shoe, the shoe opening defined by a rear part, a medial part, a lateral part, and a front part;

an elastic element in at least one of:

the medial part of the shoe, and the lateral part of the shoe;

the rear part comprising a top portion reinforced with a firm material;

a compression spring element comprising:

a top part and a bottom part configured to be compressed towards each other by the application of a force on the top part of the compression spring element, and a side profile that lays flush against a contour of the rear part of the shoe;

wherein the compression spring element is mounted inside a sleeve associated with the rear part of the shoe or embedded within the rear part of the shoe, and wherein the compression spring element is substantially centered between a left side and a right side of the rear part of the shoe, and wherein the top part of the compression spring element is attached proximate to the top portion of the rear part, and the bottom part of the compression spring element is attached to the sole.

2. The shoe according to claim 1, further comprising a vamp, an inner layer, and an outer layer, wherein a bottom part of the outer layer is attached to the sole, and wherein the inner layer is attached to the outer layer at a front part of the opening, and wherein the inner layer is separated from the outer layer in the front part of the opening area and the vamp area.

3. The shoe according to claim 1, further comprising a vamp, an inner layer, and an outer layer, wherein a bottom part of the outer layer is attached to the sole, and wherein the inner layer is attached to the outer layer at a front part of the opening, and wherein the inner layer is attached to the outer layer within at least one of: lateral side of the opening, and medial side of the opening.

4. The shoe according to claim 1, further comprising a vamp, an inner layer, and an outer layer, wherein a bottom part of the outer layer is attached to the sole, and wherein the inner layer is attached to the outer layer at a front part of the opening, and wherein the inner layer is made from a softer material than the outer layer.

5. The shoe according to claim 1, further comprising a vamp, an inner layer, and an outer layer, wherein a bottom part of the outer layer is attached to the sole, and wherein the inner layer is attached to the outer layer at a front part of the opening, and wherein the inner layer is attached to the outer layer with a stitch at the front part of the opening.

6. The shoe according to claim 1, further comprising a vamp, an inner layer, and an outer layer, wherein a bottom part of the outer layer is attached to the sole, and wherein the inner layer is attached to the outer layer at a front part of the opening, and wherein the attachment of the inner layer to the outer layer at the front part of the opening is operative to prevent a front part of the inner layer from bending when an object is inserted into the shoe.

* * * * *